US006547593B1

(12) United States Patent
Beckous

(10) Patent No.: US 6,547,593 B1
(45) Date of Patent: Apr. 15, 2003

(54) SUB-MINIATURE, HIGH SPEED COAXIAL PIN INTERCONNECTION SYSTEM

(75) Inventor: Frank R. Beckous, Newark, DE (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

(21) Appl. No.: 09/633,796

(22) Filed: Aug. 7, 2000

(51) Int. Cl.[7] ..... H01R 9/05
(52) U.S. Cl. ..... 439/581; 439/579; 439/578
(58) Field of Search ..... 439/577, 579, 439/580, 581, 578, 63

(56) References Cited

U.S. PATENT DOCUMENTS

| | | | | | |
|---|---|---|---|---|---|
| 3,161,453 | A | * | 12/1964 | Powell | 439/578 |
| 3,206,540 | A | * | 9/1965 | Cohen | 439/578 |
| 4,035,054 | A | * | 7/1977 | Lattanzi | 439/578 |
| 4,553,806 | A | * | 11/1985 | Forney, Jr. et al. | 439/578 |
| 4,669,805 | A | | 6/1987 | Kosugi et al. | 439/581 |
| 4,886,462 | A | | 12/1989 | Fierro | 439/79 |
| 4,897,046 | A | | 1/1990 | Tengler et al. | 439/579 |
| 4,990,104 | A | * | 2/1991 | Schieferly | 439/578 |
| 5,046,966 | A | * | 9/1991 | Snyder et al. | 439/579 |
| 5,190,472 | A | * | 3/1993 | Voltz et al. | 439/579 |
| 5,194,020 | A | | 3/1993 | Voltz | 439/579 |
| 5,295,863 | A | * | 3/1994 | Cady | 439/578 |
| 5,344,335 | A | | 9/1994 | Scholz et al. | 439/357 |
| 5,437,562 | A | | 8/1995 | Michael | 439/581 |
| 5,474,470 | A | * | 12/1995 | Hammond, Jr. | 439/578 |
| 5,567,179 | A | | 10/1996 | Voltz | 439/578 |
| 5,711,676 | A | | 1/1998 | Michael, III | 439/63 |
| 6,030,255 | A | * | 2/2000 | Konishi et al. | 439/578 |
| 6,146,196 | A | * | 11/2000 | Burger et al. | 439/578 |
| 6,205,340 | B1 | * | 3/2001 | Yandrofski et al. | 455/561 |
| 6,246,299 | B1 | * | 6/2001 | Werlau | 333/127 |

FOREIGN PATENT DOCUMENTS

| | | |
|---|---|---|
| DE | 3821411 | 8/1989 |
| DE | 19510186 | 9/1996 |
| EP | 0468767 | 1/1992 |
| EP | 0647985 | 4/1995 |
| EP | 0852826 | 7/1998 |
| EP | 0 999 611 A1 | 5/2000 |

OTHER PUBLICATIONS

"Board–Level Connectors—Considerations and Guidelines", Stephen T. Morley, RF Design, Cardiff PublishingCo., Englewood, CO. vol. 21, No. 3, Mar. 1, 1998, pp. 64–66–69.

* cited by examiner

*Primary Examiner*—Javaid Nasri
(74) *Attorney, Agent, or Firm*—Allan M. Wheatcraft

(57) ABSTRACT

An interconnection system comprising two coaxial cables (20, 20') connected together by matable connector halves (30*a*, 30*b*, 40*a*, 40*b*) is disclosed. A first half of the matable connector halves (30*a*, 30*b*, 40*a*, 40*b*) is a male connector half formed of a first insulating housing (40) in which is disposed at least one conductive pin (50) which is electrically connected to the center conductor (100) of one of the two coaxial cables (20, 20'). The conductive pin (50) is at least partly captivated by a first dielectric bead (60) within a first connector shield (55). The first connector shield (55) is electrically connected with the cable outer shield (110) of the same one of the two coaxial cables (20). A second half of the matable connector halves (30*a*, 30*b*, 40*a*, 40*b*) is a female connector half formed of a second insulating housing (80) in which is disposed at least one conductive receptacle (70) which is electrically connected to the cable center conductor (100') of the other one of the two coaxial cables (20') and is at least partly captivated by a second dielectric bead (90) within a second connector shield (75). The second connector shield (75) is electrically connected with the cable outer shield (110') of the other one of the two coaxial cables (20'). The conductive receptacle (70) is dimensioned to accept the conductive pin (50) and the second insulating housing (80) with second dielectric bead (90) is dimensioned to accept the first insulating housing (40) with the first dielectric bead (60).

17 Claims, 8 Drawing Sheets

SUB-MINIATURE, HIGH SPEED COAXIAL PIN INTERCONNECTION SYSTEM

BACKGROUND OF THE INVENTION

This invention relates to the interconnect of planar devices, such as PC boards, to each other as well as to any other peripheral device to which it might need to interact. A typical prior art method of performing this interconnect is to use a coaxial assembly off of each device and joining the coaxial assemblies together using an adapter. This is often costly, has poor electrical performance and also takes up too much valuable space.

FIGS. 8*a* and 8*b* show an example in separated and connected views respectively of the prior art interconnect with such an adapter 150. The adapter 150 connects two socket coaxial connectors 130 to each other which are in turn each connected to coaxial cables 20 coming to and from some signal source. The signal source can be either of a device or directly from a PC board. In the GORE "UHD" Interconnect system, which is available from W. L. Gore & Associates, Inc., Newark, Del., both of the socket coaxial connectors 130 are female connectors and the adapter 150 is constructed accordingly with pins 152 in the adapter 150. The prior art interconnect thus comprises three pieces: two socket coaxial connectors 130 and the adapter 150. The use of three individual elements degrades the electrical performance of the interconnect and requires more space.

SUMMARY OF THE INVENTION

The object of this invention is to improve the electrical performance of interconnects.

A further object of the invention is to reduce the space required for the interconnect.

Yet a further object of the invention is provide interconnects with a lower installed cost.

These and other objects of the invention are solved by providing an interconnection system comprising two coaxial cables connected together by matable connector halves. A first half of the matable connector halves is a male connector half formed of a first insulating housing in which is disposed at least one conductive pin being electrically connected to the cable center conductor of a first one of the two coaxial cables. The conductive pin is at least partly captivated by a first dielectric bead within a first connector shield and the first connector shield is electrically connected with the cable outer shield of a first one of the two coaxial cables. A second half of the matable connector halves is a female connector half formed of a second insulating housing in which is disposed at least one conductive receptacle which is electrically connected to the cable center conductor of a second one of the two coaxial cables. The at least one conductive receptacle is at least partly captivated by a second dielectric bead within a second connector shield and the second connector shield is electrically connected with the cable outer shield of a second one of the two coaxial cables. The at least one conductive receptacle is dimensioned to accept the at least one conductive pin and the second insulating housing with second dielectric bead is dimensioned to accept the first insulating housing with the first dielectric bead.

The use of the two part interconnect system of the current invention in which one part is a male connector half and the other half is a matable, female connector half means that less space is required since there is no adapter between the connector halves present within the interconnect system. Furthermore, since there is one less mechanical connection, the electrical performance of the system is maintained.

The matable connector halves of the interconnection system have more than one conductive pin, the exact number being dependent on the number of connections to be made and hence on the number of coaxial cables. The interconnection system of the current invention allows the construction of matable connector halves in which the distance between the conductive pins is between 6.0 and 3.0 mm. Furthermore, the invention permits the density of conductive pins to be between 30 and 40 per square inch (6.45 $cm^2$) which means that the connector halves of the interconnect system requires less space.

In one application of the interconnection system, terminations on the surface of an electronic circuit board are connected to one or more coaxial cables. The terminations are electrically connected to a first end of the one or more coaxial cables by the matable connector halves of the invention. It is also possible for the other end of the one or more coaxial cables to be exposed for direct connection to one of the terminations on the electronic circuit board.

DETAILED DESCRIPTION OF THE INVENTION

This invention relates to the interconnect of planar devices, such as PC boards, to each other as well as to any other peripheral device to which they might need to interact with using RF (radio frequency) pin connector assemblies.

Figure 1:
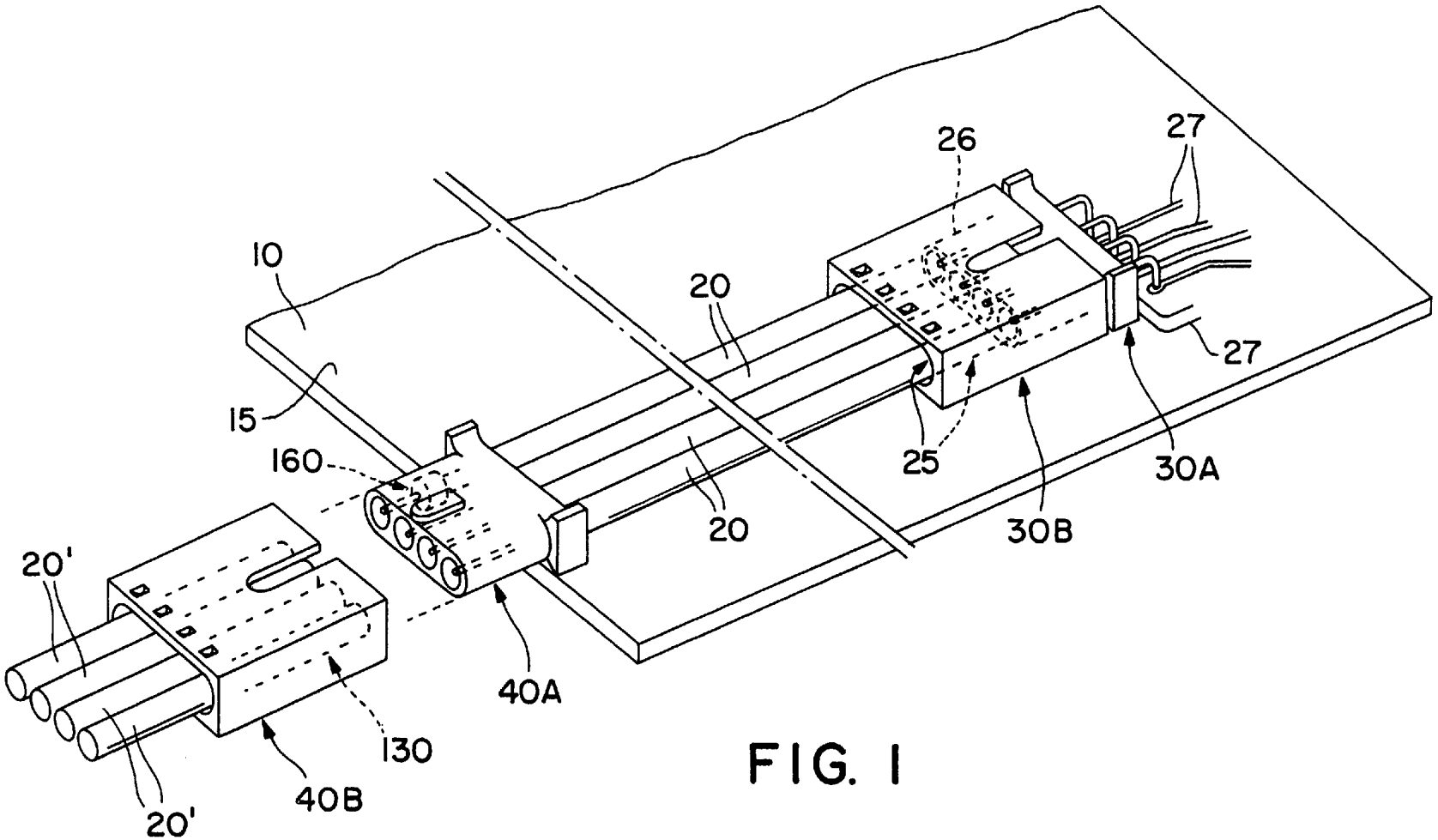
FIG. 1 is a view of one embodiment of the planar device with a surface mounted connector header.

Illustrated in FIG. 1 is one embodiment of an interconnect system according to the invention in which signals are placed on to or taken off of planar devices 10, such as a printed circuit board (PCB), via electronic circuitry 27. The electronic circuitry 27 is mounted on the upper surface 15 of the planar device 10 and connected to coaxial cables 20 by means of a connector header 30*a* which is attached to the planar device 10. Plugged into the connector header 30*a* is a connector housing 30*b* containing a set of connectors 25 complimentary to connectors 26 ganged in the connector header 30*a*. The connector header 30*a* and the connector housing 30*b* are made, for example, of thermoplastics including ULTEM® and liquid crystal polymers (LCP). The set of connectors 25 are attached to one end of coaxial cables 20, the other end of which is connected to coaxial pin connectors 160. The connectors 160 are housed in a further connector header 40*a* which in turn mates with a further connector housing 40*b* containing female connector halves 130 attached to further coaxial cables 20'. The further connector header 40*a* and the further connector housing 40*b* can be made of the same materials as the connector header 30*a* and the connector housing 30*b*.

Figure 2:
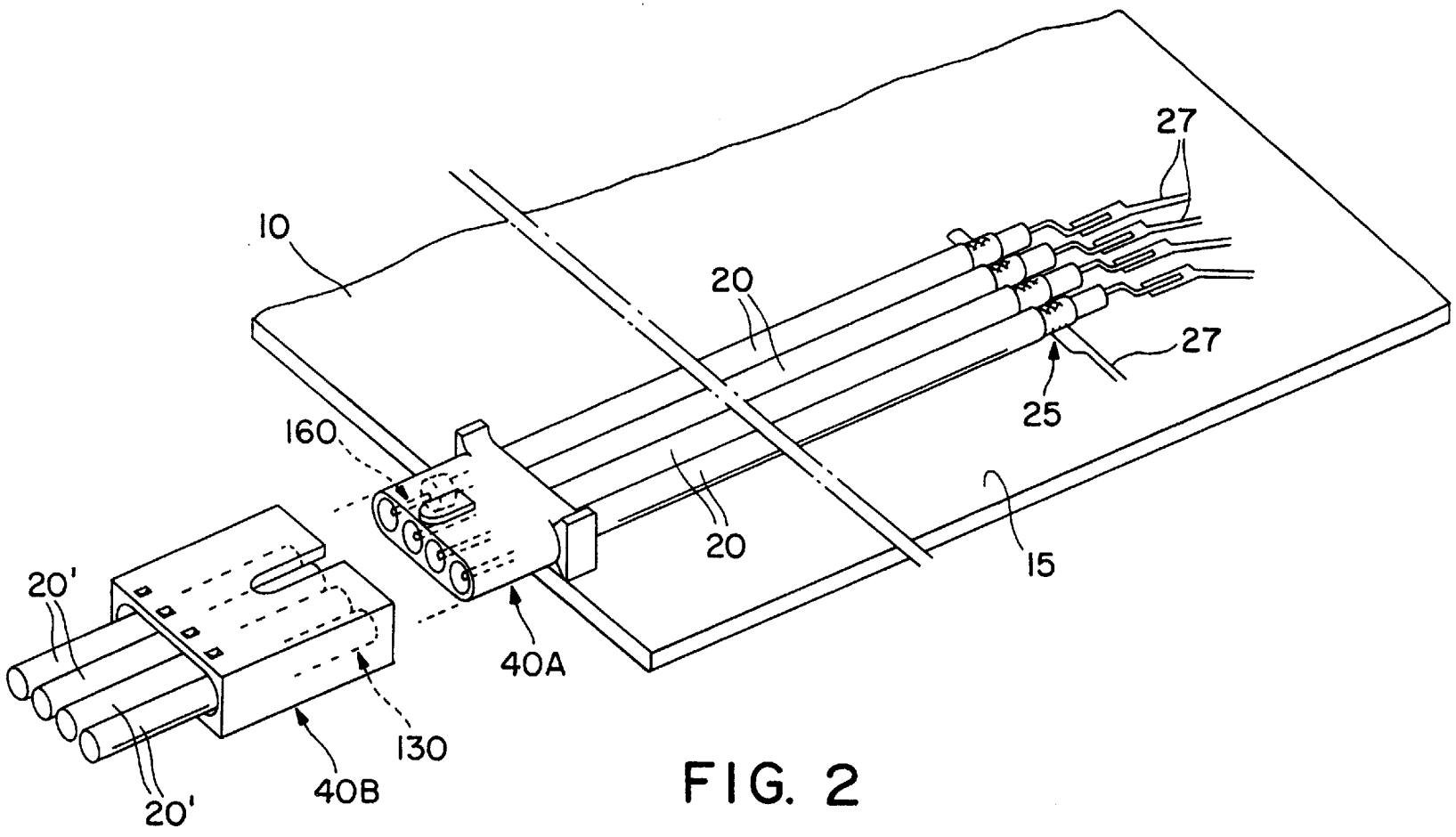
FIG. 2 is a view of a further embodiment of the planar device with cables attached directly to the planar device.
Figure 3:
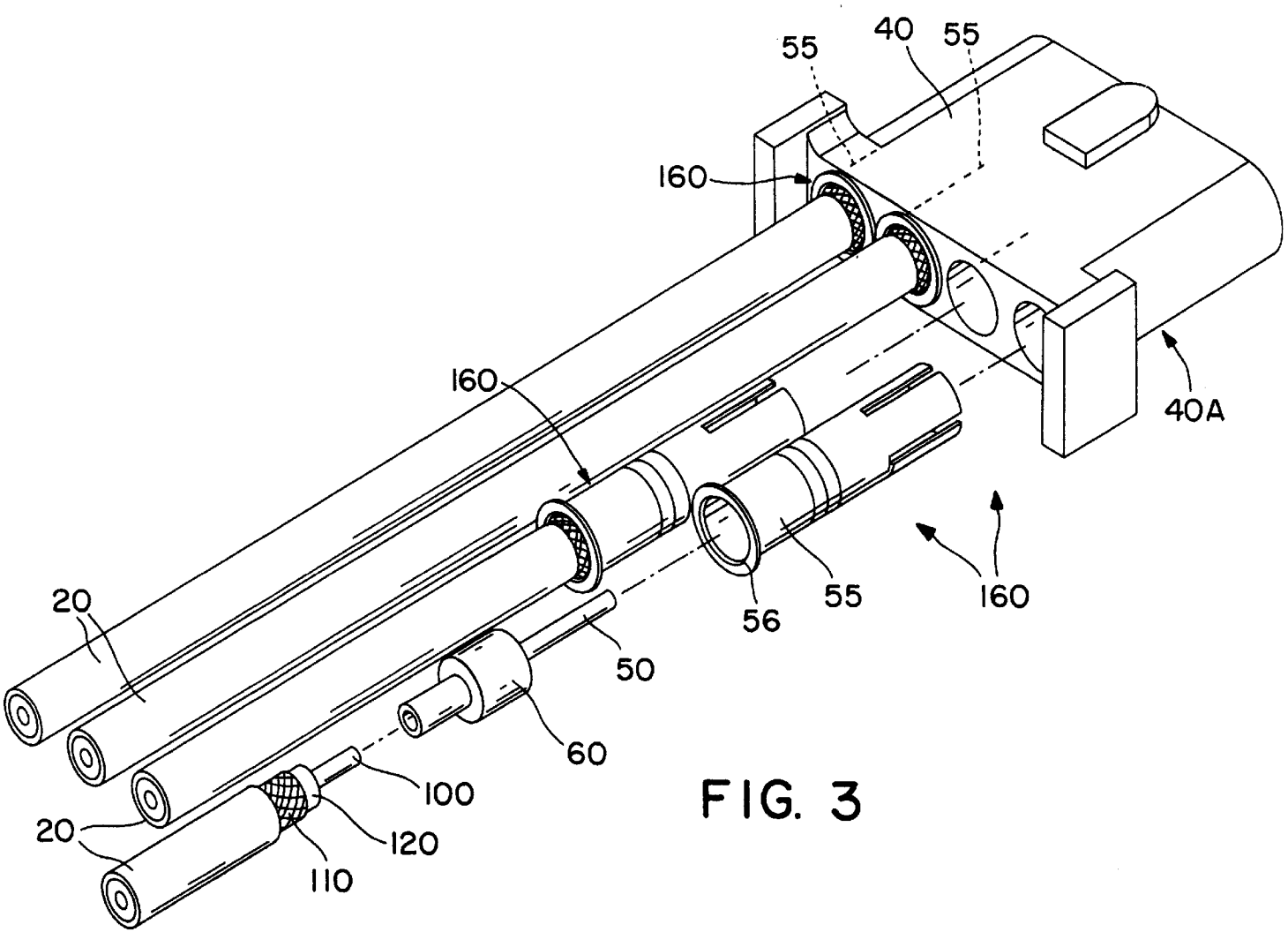
FIG. 3 is a detail view of the pin connector.

An alternative method for extracting the signal from the planar device 10 is depicted in FIG. 2 in which the coaxial cables 20 are soldered directly to the electronic circuitry 27, such as exposed circuit traces, on the surface 15 of the planar device 10. FIG. 3 shows an exploded view of the coaxial pin connector assembly 160 in the further connector header 40*a*. The coaxial cable 20 has an outer shield 110 disposed about an inner insulation 120 with a central conductor 100 in the inner insulation 120. The inner insulation 120 serves to isolate the central conductor 100 from the outer shield 110. The coaxial pin connector 160 has a central signal pin 50 connectable to the central conductor 100 of the coaxial cable 20 and an outer ground shield 55 connectable to the outer shield 110 of the coaxial cable 20. A connector insulator 60, formed of a dielectric bead, is disposed between the central signal pin 50 and the outer ground shield 55. In the same Fig., the coaxial pin connector assembly 160 is also shown as mounted in the connector header 40A. The connector insulator 60 is made of a dielectric material such as PTFE, ULTEM® or Torlon®. The central signal pin 50 is made of a conducting material such as copper, beryllium copper or phosphor bronze. The outer ground shield 55 is made of a conducting material such as copper, beryllium copper or phosphor bronze.

Figure 4:
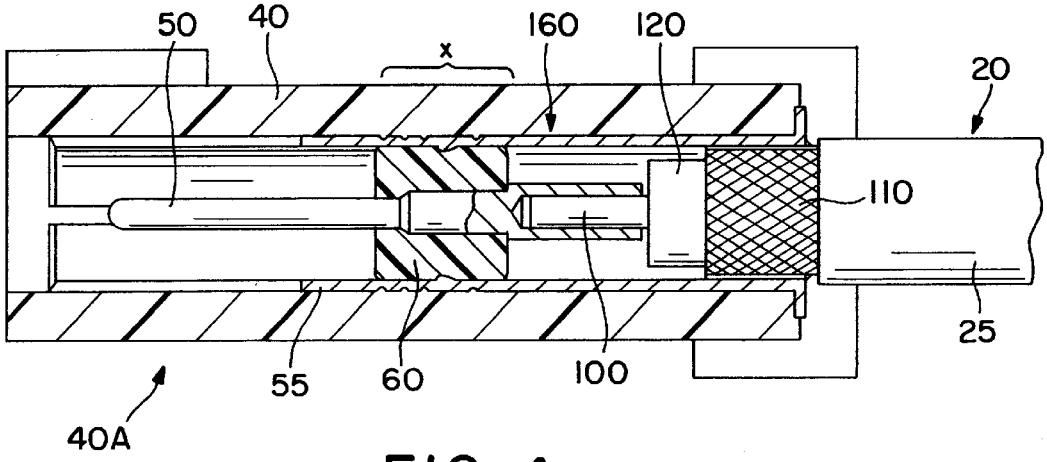
FIG. 4 is a cut-away view of the pin connector.

FIG. 4 shows a cut-away view of the pin coaxial connector 160 of FIG. 3 in assembled form. As can be seen in this Fig., the central signal pin 50 is partially captivated over a distance x by the connector insulator 60 within the connector outer shield 55. The connector outer shield 55 is electrically connected with the coaxial cable outer shield 110. Coaxial cable outer shield 110 is insulated from coaxial cable central conductor 100 by inner insulation 120. The pin coaxial connector 160 is shown ganged into the further connector header 40*a*. It will be noted that the connector outer shield 55 has a slight flare 56 at the entry end of the coaxial cable 20 which mates with a complementary recess 42 in the further connector housing 40*a*.

Figure 5:
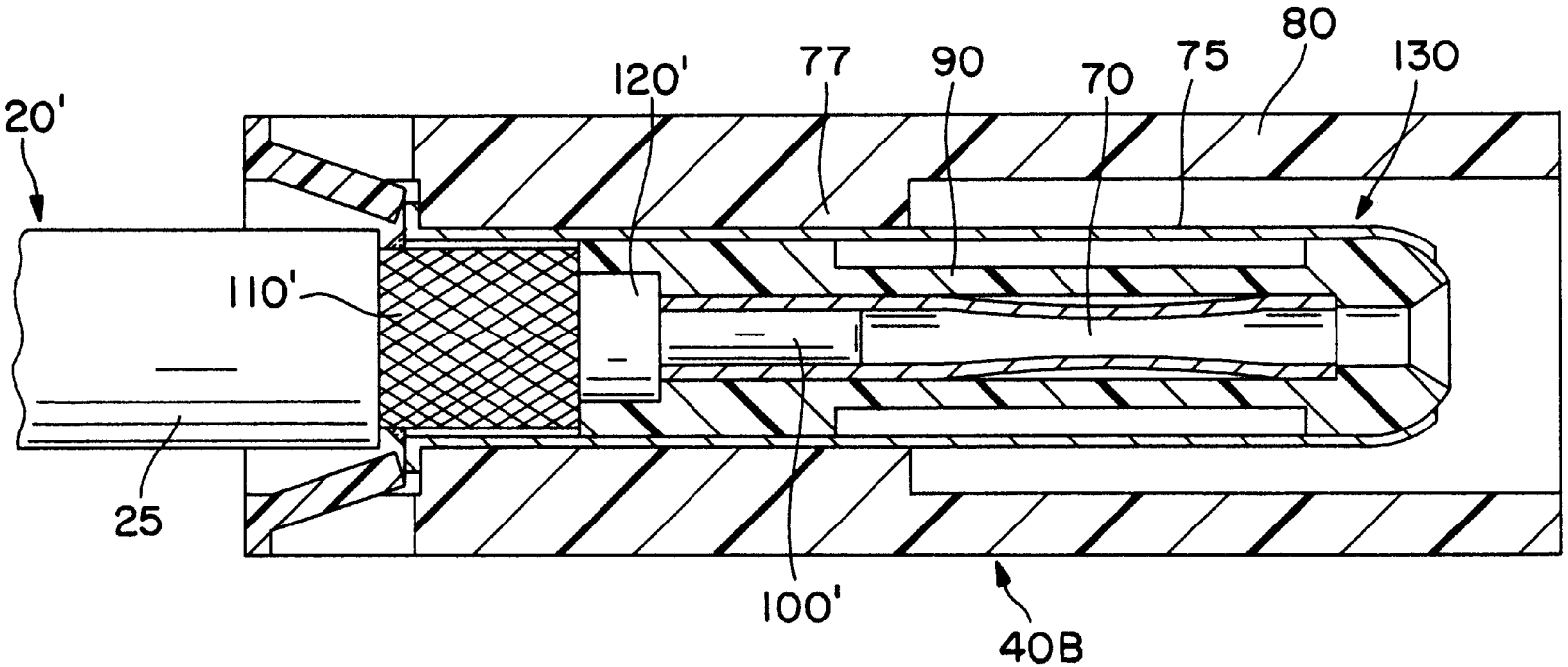
FIG. 5 is a cut-away view of the socket connector.

FIG. 5 depicts the socket coaxial connector 130 which mates to the pin coaxial connector 160 and is situated in the further connector housing 40*b*. The socket coaxial connector 130 is connected to the further coaxial cable 20'. The further coaxial cable 20' has a further outer shield 110' disposed about a further inner insulation 120' with a further central conductor 100' in the further inner insulation 120'. The further inner insulation 120' serves to isolate the further central conductor 100' from the further outer shield 110'. The socket coaxial connector central conductor 70 is electrically connected to the further central conductor 100' and is partially captivated by a dielectric bead 90 within a connector outer shield 75. The connector outer shield 75 is electrically connected with the further outer shield 110'. The socket coaxial connector 130 is shown ganged into the connector housing 80.

Figure 6A:
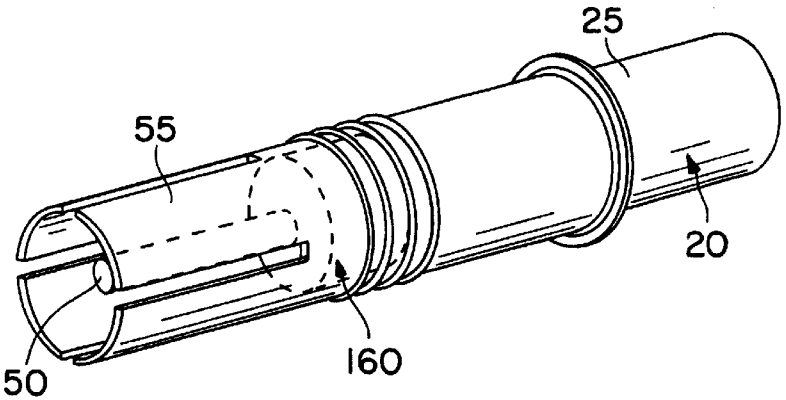
FIGS. 6*a* and 6*b* illustrate the pin to socket connection of the invention.
Figure 6B:
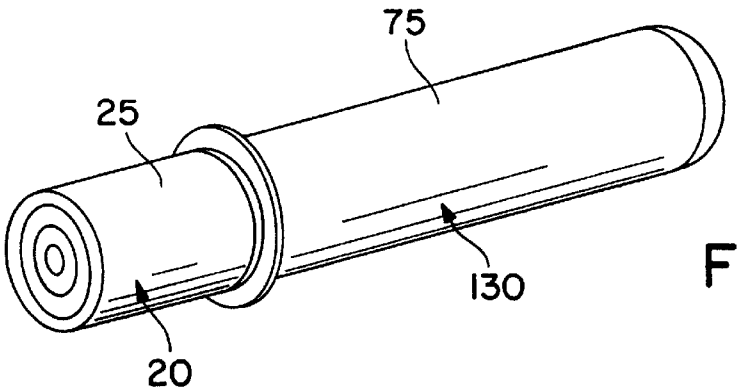
Figure 6B:
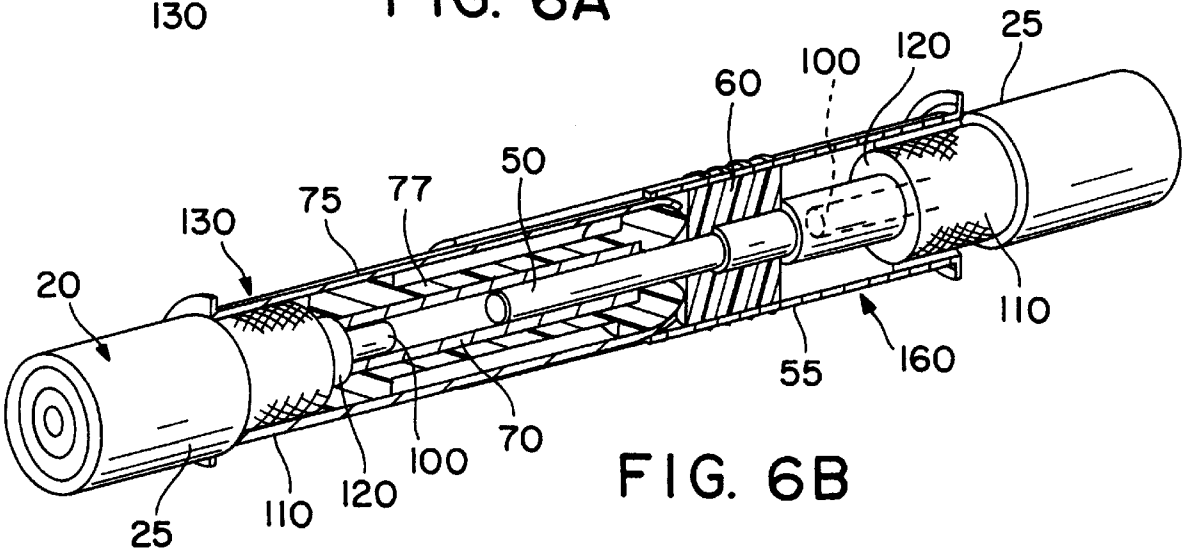

FIGS. 6*a* and 6*b* illustrate the connection method of the invention in which the socket coaxial connector 130 mates to the pin coaxial connector 160. The connector header 30*a* and the connector housing 30*b* can have any appropriate dimension. For example, the embodiments of FIGS. 1 and 2 illustrate a 1×4 arrangement which is not limiting of the invention. For example, a 1×8 arrangement or a 3×32 (3 rows and 32 positions) arrangement are conceivable depending on the individual requirements. The connector housing of the 1×4 arrangement is 0.2" high, 0.509" wide and 0.58" deep. More generally, the connector header 30*a* and the connector housing 30*b* allow up to 40 connectors per square inch to be accommodated therewithin.

The distance between pins in the further connector header 40*a* can be in the range of 3 mm to 6 mm, but this is not limiting of the invention. The mismatch between the socket coaxial connector 130 and the pin coaxial connector 160 is ideally zero. However, tolerances of up to 2.3 mm are acceptable, i.e. the mismatch on mating can be up to 2.3 mm without degradation of performance.

The interconnect system of the invention provides less than 3 dB of attenuation bandwidth through 6 GHz for coaxial cables of length of up to 48" (121 cm) as can be seen from FIG. 7.

Figure 7A:
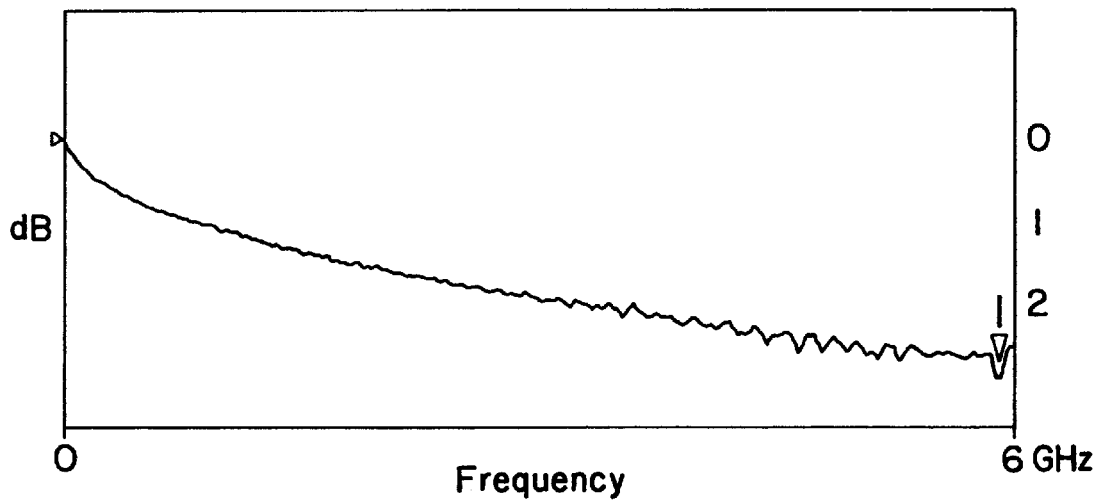
FIGS. 7*a* and 7*b* illustrate the electrical performance of the interconnection system.

FIG. 7*a* illustrates the insertion loss for a 48" (122 cm) coaxial cable 20 from a connector 30*a* of a surface mounted device to a further connector 40*a* from 0 to 6 GHz. It will be noted that the maximum loss occurs at 5.90 GHz at which point it is 2.90 dB. This is shown by the arrow in the Fig. Generally it is desirable to have a loss of less than 3 dB over this frequency range.

Figure 7B:
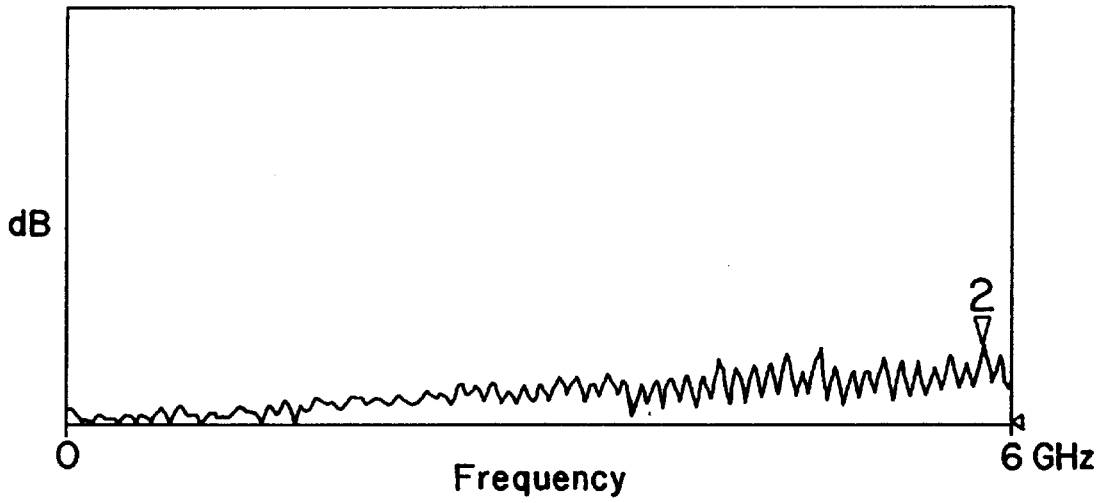
Figures 8A, 8B:
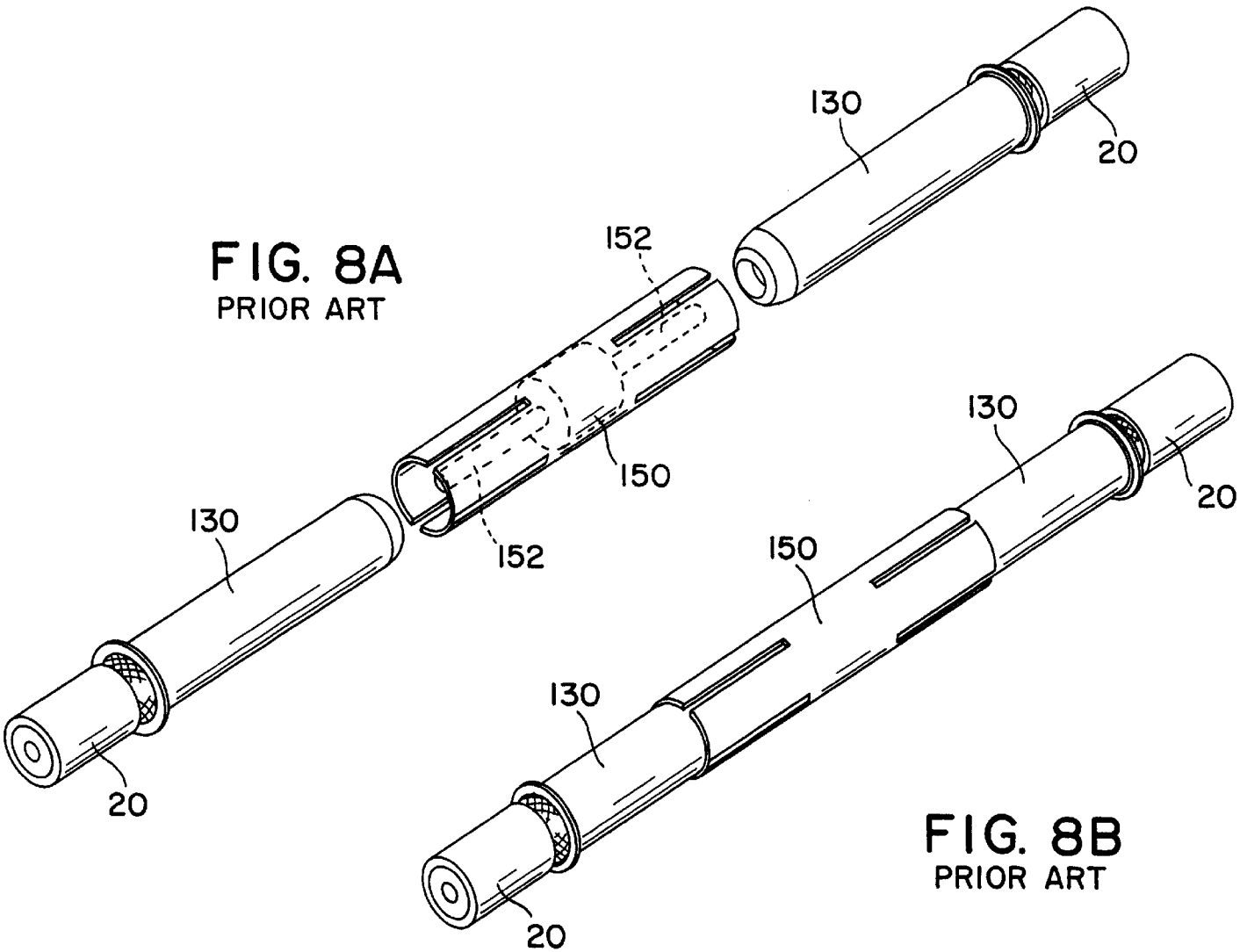
FIG. 8A PRIOR ART
FIG. 8B PRIOR ART
FIGS. 8*a* and 8*b* illustrate the prior art connection method with a pinto-pin adapter to join two socket connectors.

FIG. 7*b* shows the standing wave ratio over the same frequency range as illustrated in FIG. 7*a*. The maximum value of 1:1.185 is reached at 5.81 GHz. More generally, it is desirable to have a ratio of less than 1:1.25.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

What is claimed is:

1. Interconnection system comprising two coaxial cables connected together by mutable connector halves, each one of the two coaxial cables having a cable center conductor disposed within a cable outer shield, wherein:

a first half of the mutable connector halves is a male connector half formed of a first insulating housing in which is disposed at least one conductive pin being electrically connected to the cable center conductor of a first one of the two coaxial cables and at least partly captivated by a first dielectric bead within a first connector shield, the first connector shield being electrically connected with the cable outer shield of a first one of the two coaxial cables;

a second half of the mutable connector halves is a female connector half formed of a second insulating housing in which is disposed at least one conductive receptacle being electrically connected to the cable center conductor of a second one of the two coaxial cables and at least partly captivated by a second dielectric bead within a second connector shield, the second connector shield being electrically connected with the cable outer shield of a second one of the two coaxial cables;

the at least one conductive receptacle being dimensioned to accept the at least one conductive pin and the second insulating housing with second dielectric bead being dimensioned to accept the first insulating housing with the first dielectric bead; and wherein the insertion loss of the interconnect system is below 3 dB at a frequency of 6 Ghz.

2. The interconnection system of claim 1 wherein the first half of the matable connector halves has at least two conductive pins and the distance between the at least two conductive pins is between 6.0 and 3.0 mm.

3. The interconnection system of claim 2 wherein the density of the at least two conductive pins is between 30 and 40 per square inch (6.45 $cm^2$).

4. The interconnection system of claim 1 wherein the at least one conductive pin is concentrically captivated within the first connector shield.

5. The interconnection system of claim 1 wherein the at least one conductive receptacle is concentrically captivated within the second ground shield.

6. The interconnection system of claim 1 wherein the insertion loss for a 122 cm length of one of the coaxial cables is less than 3 dB at a frequency of 6 Ghz.

7. The interconnection system of claim 1 wherein the standing wave ratio of a 122 cm length of one of the coaxial cables is less than 1:1.25 at a frequency of 6 Ghz.

8. The interconnection system of claim 1 wherein the mismatch between conductive pin and conductive receptacle can be as large as 2.3 mm.

9. A combination of an electronic circuit board and one or more coaxial cables, each coaxial cable having a cable center conductor disposed within a cable outer shield, and the electronic circuit board having at least one terminations mounted on a surface of the electronic circuit board, the at least one termination being electrically connected to a first end of the one or more coaxial cables by matable connector halves;

whereby at least a first half of the matable connector halves is a male connector half formed of a first insulating housing in which is disposed one or more conductive pins being electrically connected to the cable center conductor and at least partly captivated by a first dielectric bead within a first connector shield, the first connector shield being electrically connected with the cable outer shield;

a second half of the matable connector halves is a female connector half formed of a second insulating housing in which is disposed one or more conductive receptacles being electrically connected to the cable center conductor and at least partly captivated by a second dielectric bead within a second connector shield, the second connector shield being electrical connected with the cable outer shield;

the one or more conductive receptacles being dimensioned to accept the one or more conductive pins and the second insulating housing with second dielectric bead being dimensioned to accept the first insulating housing with the first dielectric bead; wherein the insertion loss for a 122 cm length of one of the coaxial cables is less than 3 dB at a frequency of 6 Ghz.

10. The combination of claim 9 wherein the first half of the matable connector halves has at least two conductive pins and the distance between the at least two conductive pins is between 6.0 and 3.0 mm.

11. The combination claim 9 wherein the density of the at least two conductive pins is between 30 and 40 per square inch (6.45 $cm^2$).

12. The combination of claim 9 wherein the one or more conductive pins are concentrically captivated within the first connector shields.

13. The combination of claim 9 wherein the one or more conductive receptacles are concentrically captivated within the second ground shields.

14. The combination of claim 9 wherein a second end of the one or more coaxial cables is exposed for direct connection to one of the terminations on the electronic circuit board.

15. The combination of claim 14 wherein the terminations comprise printed circuit traces.

16. The combination of claim 9 wherein the standing wave ratio of a 122 cm length of one of the coaxial cables is less than 1:1.25 at a frequency of 6 Ghz.

17. The combination of claim 9 wherein the mismatch between conductive pin and conductive receptacle can be as large as 2.3 mm.

* * * * *

UNITED STATES PATENT AND TRADEMARK OFFICE

CERTIFICATE OF CORRECTION

PATENT NO. : 6,547,593 B1
DATED : April 15, 2003
INVENTOR(S) : Frank Beckous

It is certified that error appears in the above-identified patent and that said Letters Patent is hereby corrected as shown below:

Column 4,
Lines 33, 36 and 45, change “mutable” to -- matable--.

Signed and Sealed this

Twenty-fourth Day of June, 2003

JAMES E. ROGAN
*Director of the United States Patent and Trademark Office*